US008419268B2

(12) United States Patent
Yu

(10) Patent No.: US 8,419,268 B2
(45) Date of Patent: Apr. 16, 2013

(54) WEARABLE ELECTRONIC DEVICE

(75) Inventor: Qi Yu, Shenzhen (CN)

(73) Assignees: Hong Fu Jin Precision (ShenZhen), Shenzhen (CN); Hon Hai Precision Industry Co., Ltd., New Taipei ( * ) Notice: Subject to any disclaimer, the term of this patent is extended or adjusted under 35 U.S.C. 154(b) by 221 days.

(21) Appl. No.: 12/962,587

(22) Filed: Dec. 7, 2010

(65) Prior Publication Data

US 2012/0051193 A1 Mar. 1, 2012

(30) Foreign Application Priority Data

Sep. 1, 2010 (CN) ..... 2010 1 0269293

(51) Int. Cl.
*A44C 5/00* (2006.01)

(52) U.S. Cl.
USPC ..... 368/281; 368/204

(58) Field of Classification Search ..... 368/204, 368/293, 281–284
See application file for complete search history.

(56) References Cited

U.S. PATENT DOCUMENTS 4,941,236 A * 7/1990 Sherman et al. ..... 24/303
5,569,549 A * 10/1996 Redford ..... 429/1
5,763,112 A * 6/1998 Redford ..... 429/1
2005/0102802 A1* 5/2005 Sitbon et al. ..... 24/303
2010/0156184 A1* 6/2010 Ludtke ..... 307/66
2011/0096513 A1* 4/2011 Kim ..... 361/747
2011/0176395 A1* 7/2011 Mooring ..... 368/276
2012/0206088 A1* 8/2012 Park ..... 320/106

FOREIGN PATENT DOCUMENTS

CN 2865004 Y 1/2007
JP 2000-357542 * 12/2000
KR 2002-0086426 * 11/2002

* cited by examiner

*Primary Examiner* — Sean Kayes
(74) *Attorney, Agent, or Firm* — Altis Law Group, Inc.

(57) ABSTRACT

A wearable electronic device includes a main body and a battery module to provide power to the main body. The main body includes a first power contact arranged on a bottom thereof and a first magnet arranged therein. The battery module includes a sealed case, a battery received in the case, a second magnet received in the case, and a second power contact arranged on an upper surface of the case and configured to electrically connect to the battery. When the main body and the battery module are attached to each other through magnetic attractive force between the first magnet and the second magnet, the second power contact is electrically connected to the first power contact.

7 Claims, 2 Drawing Sheets

WEARABLE ELECTRONIC DEVICE

BACKGROUND

1. Technical Field

The present disclosure relates to wearable electronic devices and, more particularly, to a wrist-worn electronic device with a battery that can be easily replaced.

2. Description of Related Art

Small portable electronic devices are often powered by one-time batteries. When the electricity stored in a battery of a device (e.g., a watch) is used up, the watch must be opened up to replace the battery with a new one, which is inconvenient and can affect water resistance of the watch.

BRIEF DESCRIPTION OF THE DRAWINGS

The components in the drawings are not necessarily drawn to scale, the emphasis instead being placed upon clearly illustrating the principles of the present disclose. Moreover, in the drawings, like reference numerals designate corresponding parts throughout the several views.

DETAILED DESCRIPTION

The disclosure is illustrated by way of example and not by way of limitation. It should be noted that references to "an" or "one" embodiment in this disclosure are not necessarily to the same embodiment, and such references mean at least one.

Figure 1:
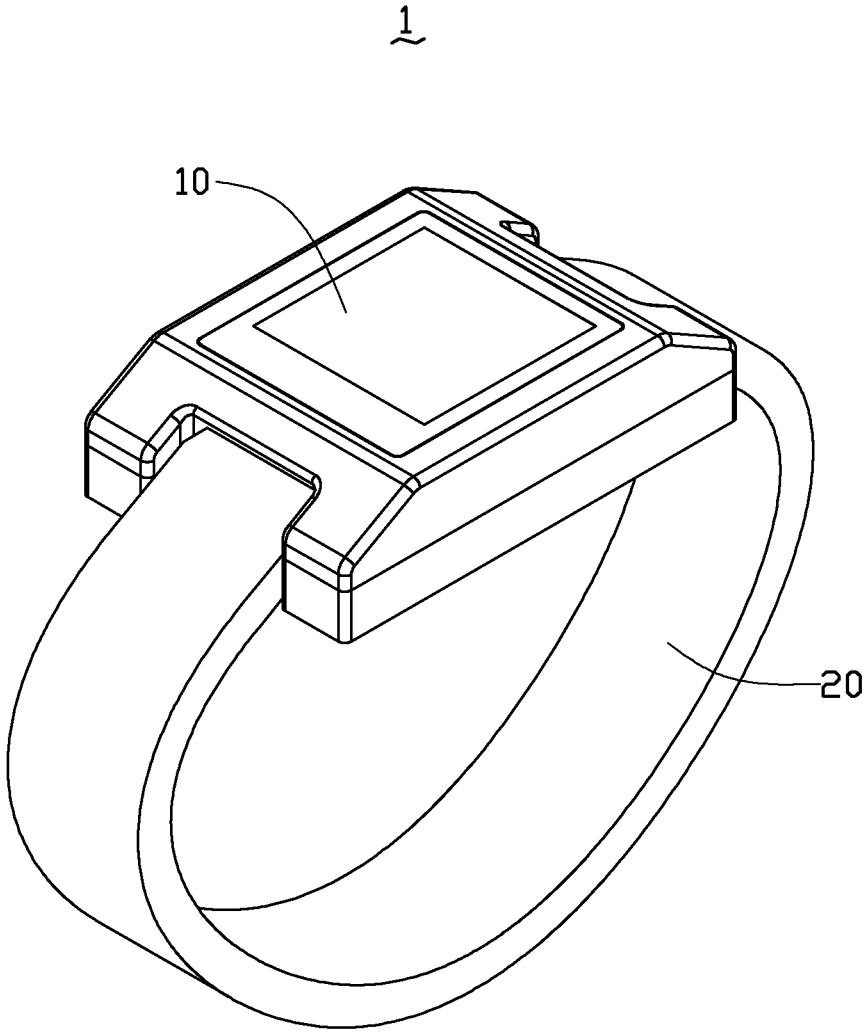
FIG. 1 is an isometric view of a wearable electronic device in accordance with an exemplary embodiment.
Figure 2:
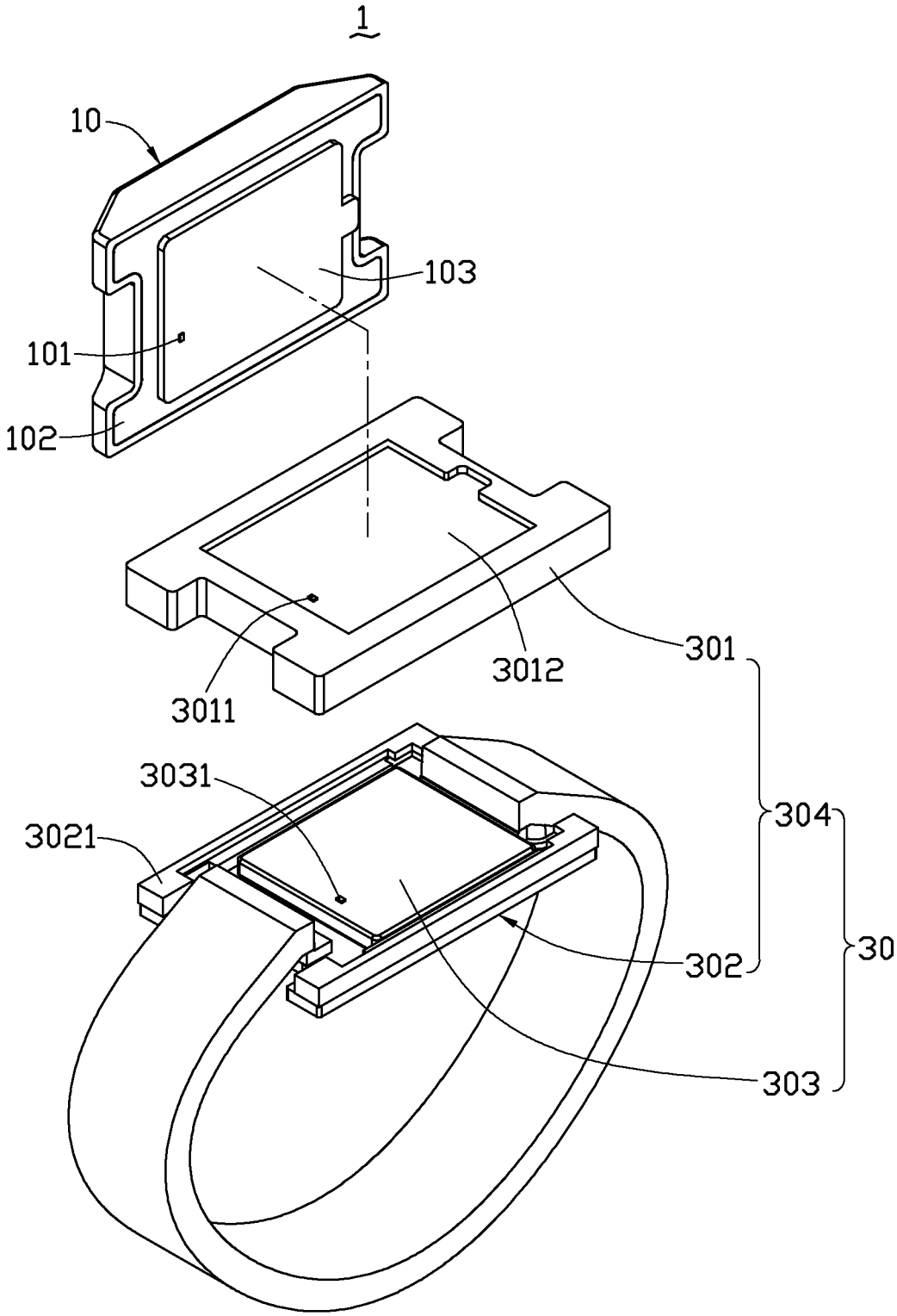
FIG. 2 is an isometric, exploded view of the wearable electronic device of FIG. 1.

Referring to FIGS. 1-2, a wearable electronic device 1 includes a main body 10 and a battery module 30 used to provide power to the main body 10. In the embodiment, the battery module 30 is arranged under the main body 10 and tightly connected to the main body 10. The device 1 can be, for example, a wristwatch, and further includes a watchband 20 connected to the battery module 30. In another embodiment, the device 1 may be a mobile phone, a camera, or a media player.

The main body 10 is a sealed structure and accommodates electronic components required by the device 1. The main body 10 further includes a first power contact 101 and a first magnet 102 arranged on the bottom of the main body 10 respectively. The first power contact 101 is used to electrically connect to the corresponding contacts of the battery module 30. In the embodiment, the first power contact 101 is made of conductive material, such as copper or iron. In an alternative embodiment, the first magnet 102 is arranged in the main body 10. The main body 10 includes at least two first power contacts 101.

The battery module 30 includes a sealed case 304 and a battery 303 received in the case 304. The battery module 30 further includes a second power contact 3011 arranged on the surface of the case 304 to electrically connect to the first power contact 101. A power pin 3031 of the battery 303 is arranged under the second power contact 3011 to connect to the first power contact 101 on the main body 103. In the embodiment, the sealed case 304 includes a cover 301 and a base 302. The base 302 defines a chamber to receive the battery 303. The second power contact 3011 is arranged on the upper surface of the cover 301 and can be made of copper or iron. In an alternative embodiment, the battery module 30 includes at least two second power contacts 3011 and the battery 303 includes at least two power pins 3031 corresponding to the at least two first power contacts 3011.

The battery module 30 further includes a second magnet 3021 arranged in the case 304. In the embodiment, the second magnet 3021 is a ring arranged around the battery 303. When the main body 10 is put on the battery module 30, the first magnet 102 and the second magnet 3021 are attached to each other because of the magnetic attraction. The main body 10 and the battery module 30 can be conveniently separated from each other by using sufficient force to overcome the magnetic attraction between the first magnet 102 and the second magnet 3021. The battery module 30 or battery 303 can then be replaced.

In order to ensure a good connection between the main body 10 and the battery module 30, the main body 10 includes a convex surface 103, and the sealed case 304 includes a concave surface 3012 corresponding to the convex surface 103. The convex surface 103 and the concave surface 3012 match to allow the first power contact 101 to tightly contact the second power pin 3031.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A wearable electronic device comprising:

a main body comprising a first magnet arranged therein and a first power contact arranged on a bottom thereof; and a battery module comprising:

a sealed case, comprising a cover and a base tightly connected to the cover;

a battery received in the sealed case and arranged between the cover and the base;

a second magnet received in the sealed case; and a second power contact arranged on an upper surface of the cover, a power pin of the battery being arranged under the second power contact to electrically connect to the first power contact on the main body, wherein when the main body and the battery module are attached to each other through magnetic attraction between the first magnet and the second magnet, the second power contact is electrically connected to the first power contact; and a watchband connected to the battery module.

2. The wearable electronic device as described in claim 1, wherein the main body comprises a convex surface and the sealed case comprises a concave surface corresponding to the convex surface.

3. The wearable electronic device as described in claim 2, wherein the first power contact is arranged on the convex surface, the second power contact is arranged on the concave surface, and the contacts of the battery are configured to electrically connect to the second power contact.

4. The wearable electronic device as described in claim 1, wherein the first power contact and the second power contact are made of copper or iron.

5. The wearable electronic device as described in claim 1, wherein the main body comprises at least two first power contacts, the battery module comprises at least two second power contacts and the battery comprises at least two power pins corresponding to the at least two first power contacts.

6. The wearable electronic device as described in claim 1 being a mobile phone, a media player, or a camera.

7. The wearable electronic device as described in claim 1 being a wristwatch.

* * * * *